US010653191B2

(12) United States Patent
Pfanner

(10) Patent No.: US 10,653,191 B2
(45) Date of Patent: May 19, 2020

(54) GARMENT, PARTICULARLY A PROTECTIVE VEST, AND ZIPPER ARRANGEMENT

(71) Applicant: Pfanner Schutzbekleidung GmbH, Koblach (AT)

(72) Inventor: Anton Pfanner, Hohenems (AT)

(73) Assignee: PFANNER SCHUTZBEKELEIDUNG GMBH, Koblach (AT)

( * ) Notice: Subject to any disclaimer, the term of this patent is extended or adjusted under 35 U.S.C. 154(b) by 0 days.

(21) Appl. No.: 15/554,147

(22) PCT Filed: Mar. 10, 2017

(86) PCT No.: PCT/EP2017/055720
§ 371 (c)(1),
(2) Date: Aug. 28, 2017

(87) PCT Pub. No.: WO2017/157804
PCT Pub. Date: Sep. 21, 2017

(65) Prior Publication Data

US 2018/0368486 A1 Dec. 27, 2018

(30) Foreign Application Priority Data

Mar. 17, 2016 (DE) ..... 10 2016 105 007

(51) Int. Cl.
*A41D 1/04* (2006.01)
*A41D 15/00* (2006.01)
*A44B 19/24* (2006.01)

(52) U.S. Cl.
CPC ..... *A41D 1/04* (2013.01); *A41D 15/00* (2013.01); *A41D 15/002* (2013.01); *A44B 19/24* (2013.01);
(Continued)

(58) Field of Classification Search
CPC .... A41D 1/04; A41D 15/00; A41D 2300/322; A41D 2300/20; A41D 2300/24;
(Continued)

(56) References Cited

U.S. PATENT DOCUMENTS 1,927,179 A 9/1933 Levinsohn
2,293,444 A * 8/1942 Muccillo ..... A41D 1/04 2/102
(Continued)

FOREIGN PATENT DOCUMENTS

CA 2 652 174 A1 8/2010
CA 2977815 A1 9/2017
(Continued)

OTHER PUBLICATIONS

International Search Report for PCT/EP2017/055720 dated Jun. 6, 2017 (6 pages).

*Primary Examiner* — Amy Vanatta
(74) *Attorney, Agent, or Firm* — Fitch, Even, Tabin & Flannery, LLP

(57) ABSTRACT

A garment, preferably a protective vest, which is adjustable in its size is provided. According to one approach, at least one outer zipper having two rows of teeth is provided, wherein the garment has a first size in a closed state of the outer zipper and a second size in an opened state of the outer zipper, wherein the first size is smaller than the second size, and wherein, in the opened state of the outer zipper, the rows of teeth are held together at a distance by material covered by the outer zipper in the closed state of the outer zipper. Other embodiments include a zipper arrangement.

2 Claims, 4 Drawing Sheets

(52) U.S. Cl.
CPC .... *A41D 2300/20* (2013.01); *A41D 2300/322* (2013.01)

(58) Field of Classification Search
CPC ..... A41D 27/04; A41D 27/02; A41D 1/21; A41D 1/02; A41D 1/14; A41D 1/18; A41D 11/00; A41D 15/02; A41D 13/00; A41D 15/002; A41D 2400/38; A41F 1/008; A41F 1/04; A44B 19/08; A44B 19/38; A44B 19/24
USPC ..... 2/96; 24/382
See application file for complete search history.

(56) References Cited

U.S. PATENT DOCUMENTS 2,582,772 A * 1/1952 Egbert ..... A41D 15/00 2/95
2,636,176 A 4/1953 Ross
3,110,903 A 11/1963 Burchard
3,230,545 A * 1/1966 Galley ..... A41D 1/21 2/74
3,584,323 A 6/1971 Worley
3,665,516 A * 5/1972 Orovan ..... A41D 15/002 2/211
3,771,169 A * 11/1973 Edmund ..... B63C 11/04 2/125
4,574,397 A 3/1986 Dennard
5,033,127 A * 7/1991 Schmeltz ..... A41D 15/002 2/125
6,058,508 A * 5/2000 Brown ..... A41D 15/002 2/69
6,792,621 B2 9/2004 Braun
6,961,962 B1 * 11/2005 Lewis ..... A41D 13/0002 2/81
7,832,022 B1 11/2010 Peters
10,100,679 B2 10/2018 Geveci et al.
2003/0126667 A1 7/2003 Braun et al.
2004/0111783 A1 * 6/2004 Lee ..... A41D 1/00 2/93
2004/0143884 A1 * 7/2004 Majerfeld ..... A41D 3/00 2/96
2004/0209018 A1 10/2004 Lookholder
2006/0107434 A1 5/2006 Rowe et al.
2006/0277653 A1 * 12/2006 Okajima ..... A41D 3/00 2/93
2007/0266472 A1 11/2007 DuFaux
2008/0086794 A1 4/2008 Gardner, III
2009/0265829 A1 * 10/2009 Gomes Seguin et al. ..... A41D 3/04 2/87
2010/0127025 A1 * 5/2010 Kelling ..... A41D 15/04 224/153
2010/0168636 A1 * 7/2010 Allard ..... A61F 5/0111 602/62
2011/0185476 A1 8/2011 Boisseau et al.
2012/0096622 A1 4/2012 Johnson
2014/0245519 A1 * 9/2014 Ly ..... A44B 19/26 2/93
2016/0008178 A1 * 1/2016 Babic ..... A61F 13/085 602/62
2018/0255853 A1 * 9/2018 Spathas ..... A41D 15/00

FOREIGN PATENT DOCUMENTS

CA 2996712 A1 9/2017
CN 2245866 Y 1/1997
CN 202168458 U 3/2012
CN 202873836 U 4/2013
CN 203302369 U 11/2013
CN 203676320 U 7/2014
CN 205106439 U 3/2016
DE 298 02 758 U1 6/1999
DE 102 49 196 A1 7/2003
DE 10 2004 034 654 A1 1/2006
JP S5842109 U 3/1983
JP H01 177223 U 12/1989
JP H0596009 U 12/1993
JP 3021748 U 3/1996
JP 2007236659 A 9/2007
KR 2009 0127794 A 12/2009

* cited by examiner

GARMENT, PARTICULARLY A PROTECTIVE VEST, AND ZIPPER ARRANGEMENT

CROSS-REFERENCE TO RELATED APPLICATIONS

This application is a U.S. national phase application filed under 35 U.S.C. § 371 of International Application No. PCT/EP2017/055720, filed Mar. 10, 2017, designating the United States, which claims priority from German Patent Application No. 10 2016 105 007.5, filed Mar. 17, 2016, which are hereby incorporated herein by reference in their entirety for all purposes.

FIELD

The invention relates to a garment, particularly a protective vest, which is adjustable in its size.

The invention further relates to a zipper arrangement.

BACKGROUND

Garments adjustable in size are known in numerous variants. This also applies to protective vests. The term "protective vest" is to be understood in its most general sense here. It includes warning vests, safety vests, working vests, etc., to name only a few examples of protective vests. Adjustability in size in currently known protective vests is, for example, provided by hook-and-loop fasteners being fixable in different positions. This is, as such, an implementable solution, such protective vests, however, being comparably complex in manufacturing. Further, adjusting hook-and-loop fasteners may be difficult or troublesome. Also, hook-and-loop fasteners tend to lose their functionality with time under unfavourable conditions.

The invention is based on the object to provide a garment adjustable in its size which is easy to manufacture, can be effortlessly converted into the various size adjustments, and exhibits no or hardly any wear in the area of the means for size adaptation.

Said object is solved by the features of the independent claim.

Advantageous embodiments of the invention are specified in the dependent claims.

SUMMARY

The invention is based on the generic garment adjustable in its size in that at least one outer zipper having two rows of teeth is provided, wherein the garment has a first size in a closed state of the outer zipper and a second size in a opened state of the outer zipper, wherein the first size is smaller than the second size, and wherein the rows of teeth are held together at a distance in the opened state of the outer zipper by material covered by the outer zipper in the closed state of the outer zipper. Here, the adjustability in size is also provided for by one or more zippers. The manufacturing of garments having zippers is easy and low in cost. Further, zippers of appropriate quality have an extremely long service life. Based on the invention, the garment can be effortlessly adjusted in its size. The only thing that needs to be done is to open a zipper, and immediately a larger garment is available. The other way round, the only thing that needs to be done is to close a zipper to make the garment smaller. Particularly with regard to protective vests the simple adjustability in size is of special advantage since protective vests are worn above other garments having different volumes. In summer, a protective vest will possibly be worn above nothing more than a shirt so that a small size of the protective vest is sufficient while in winter it may be required to put on the protective vest, for example, above a voluminous down jacket. Apart from the advantage that, owing to the different sizes of one and the same protective vest, different garments of the same wearer are admissible, it is also so that one and the same protective vest may be used for persons having different dress sizes. This rationalises the manufacturing process, and it provides for a significant facilitation of storage and distribution. The garment according to the invention may, for example, also be an identification vest or a vest with a number, for example for competitions.

The invention is advantageously further developed in that at least one other row of teeth is provided which is at least partly covered by the outer zipper in the closed state of the outer zipper, which is exposed in the opened state of the outer zipper, and which can be coupled with one of the rows of teeth of the outer zipper in the way of a zipper. Thus, not only two different sizes of the garment are available. By coupling a row of teeth of the outer zipper with the other row of teeth, rather, another size can be made available. The term "covered" is no definition in the strictly geometrical sense so that, for example, the zipper would have to be superposed by the row of teeth in any projection. What is meant is rather that the row of teeth is covered by whatever. This applies to all embodiments of the present disclosure.

Likewise, it may be contemplated that an inner zipper having two rows of teeth is provided which is at least partly covered by the outer zipper in the closed state of the outer zipper and which is exposed in the opened state of the outer zipper, and that, in the opened state of the outer zipper and in the opened state of the inner zipper, at least one of the rows of teeth of the outer zipper can be coupled with at least one of the rows of teeth of the inner zipper in the way of a zipper. In this way also, additional sizes are realisable.

The invention is further developed in a particularly advantageous way in that, in the opened state of the inner zipper, the rows of teeth are held together at a distance by a material which is covered by the inner zipper in the closed state of the inner zipper. So if, for example, exactly one outer and one inner zipper are present, apart from the smallest size with the outer zipper closed, two additional sizes are adjustable by only opening the outer and opening the inner zipper. If the rows of teeth of the zippers are then combined among each other, at least one additional size of the garment can be made available.

Furthermore, it may be contemplated that at least one other row of teeth is provided which is at least partly covered by the inner zipper in the closed state of the inner zipper, which is exposed in the opened state of the inner zipper, and which can be coupled with one of the rows of teeth of the inner zipper and/or of the outer zipper in the way of a zipper. Insofar, the principle of the present invention is expandable step by step. Again and again further rows of teeth or further zippers may be added, the rows of teeth present then being all or partly combinable with each other.

In this sense it is particularly advantageous that a further inner zipper having two rows of teeth is provided which is at least partly covered by the inner zipper in the closed state of the inner zipper and which is exposed in the opened state of the inner zipper, and that, in the opened state of the outer zipper, of the inner zipper, and of the further inner zipper, at least one of the rows of teeth of the inner zipper and/or at least one row of teeth of the outer zipper can be coupled with at least one of the rows of teeth of the further inner zipper in the way of a zipper.

A garment according to the invention may defined in that a plurality of zippers are provided, wherein zippers located further toward the outside, respectively, cover zippers located further toward the inside in the closed state of the zippers located further toward the outside, respectively, and the zippers located further toward the inside are exposed in the opened state the zippers located further toward the outside, respectively, and in that at least one row of teeth of a zipper can be coupled with at least one row of teeth of another zipper in the way of a zipper.

It may further be contemplated that at least one other row of teeth is provided which can be coupled with at least one row of teeth of a zipper among the plurality of zippers in the way of a zipper.

It is particularly advantageous that a zipper arrangement is provided by the zipper(s), and that zipper arrangements are provided in a plurality of positions of the garment. For example, it may be contemplated that, in protective vests, a zipper arrangement is disposed on each side of the protective vest, respectively.

In this connection it may be useful that the zipper arrangements are, at least partly, identical in design. All zipper arrangements will then have the same functionality.

However, it may also be useful that the zipper arrangements are, at least partly, different in design. In laterally provided zipper arrangements of protective vests, for example, one of the sides may be more complex in design than the other. This is particularly useful where the vest has other functional features which might impose constraints on the design of the zipper arrangements.

The invention is also realized in a zipper arrangement suitable for use in a garment according to the invention and defined in connection with the garment according to the invention.

BRIEF DESCRIPTIONS OF THE DRAWINGS

The invention will now be explained by way of example in connection with preferred embodiments with reference to the accompanying drawings.

DETAILED DESCRIPTION

Figure 1:
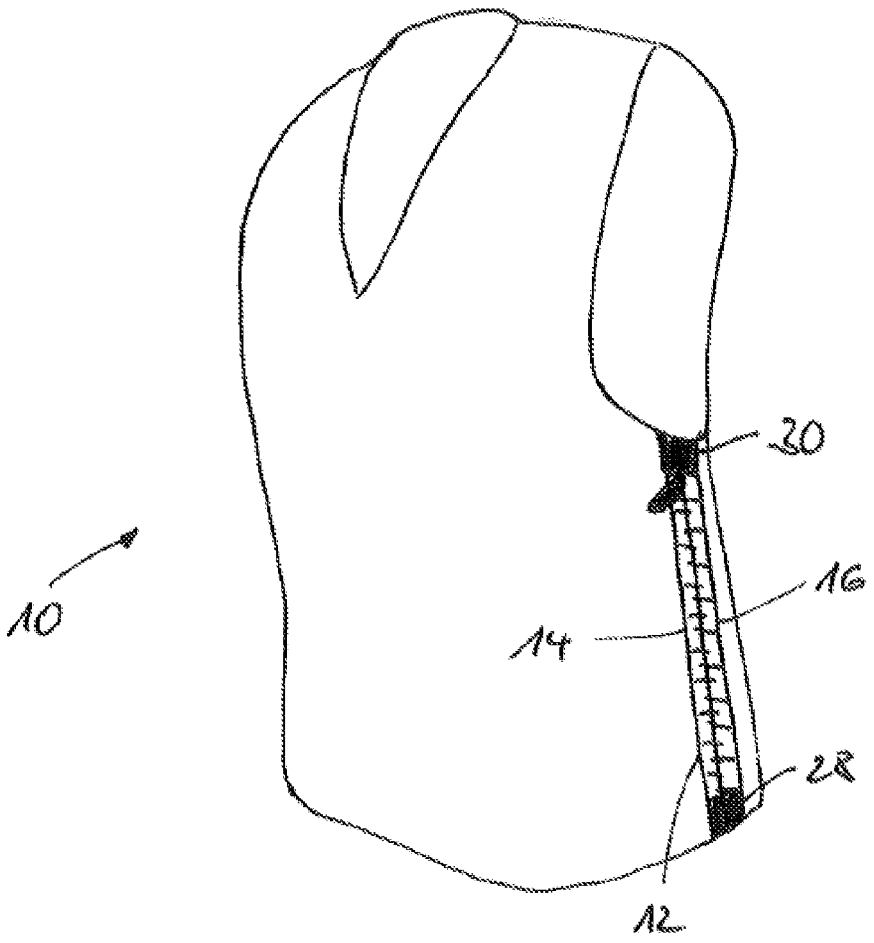
FIG. 1 shows a garment according to the invention in a first state.

FIG. 1 shows a garment 10 according to the invention in a first state. The garment 10 is a vest. The garment 10 is provided with a zipper arrangement, only an outer zipper 12 being visible in the illustration of FIG. 1. Further components of the zipper arrangement are covered by the zipper 12 or the material of the garment 10 adjacent to the zipper 12. The zipper 12 comprises two rows of teeth 14, 16, an end piece 28 and a slider 30. The zipper extends from an arm opening of the garment 10 to the lower edge of the garment 10. In the closed state, the slider 30 is positioned at the arm opening while the end piece 28 is located at the lower edge. It is likewise possible to apply the zipper 12 the other way around so that the end piece 28 is located at the arm opening, and the slider 30 is positioned at the lower edge of the garment.

Figure 2:
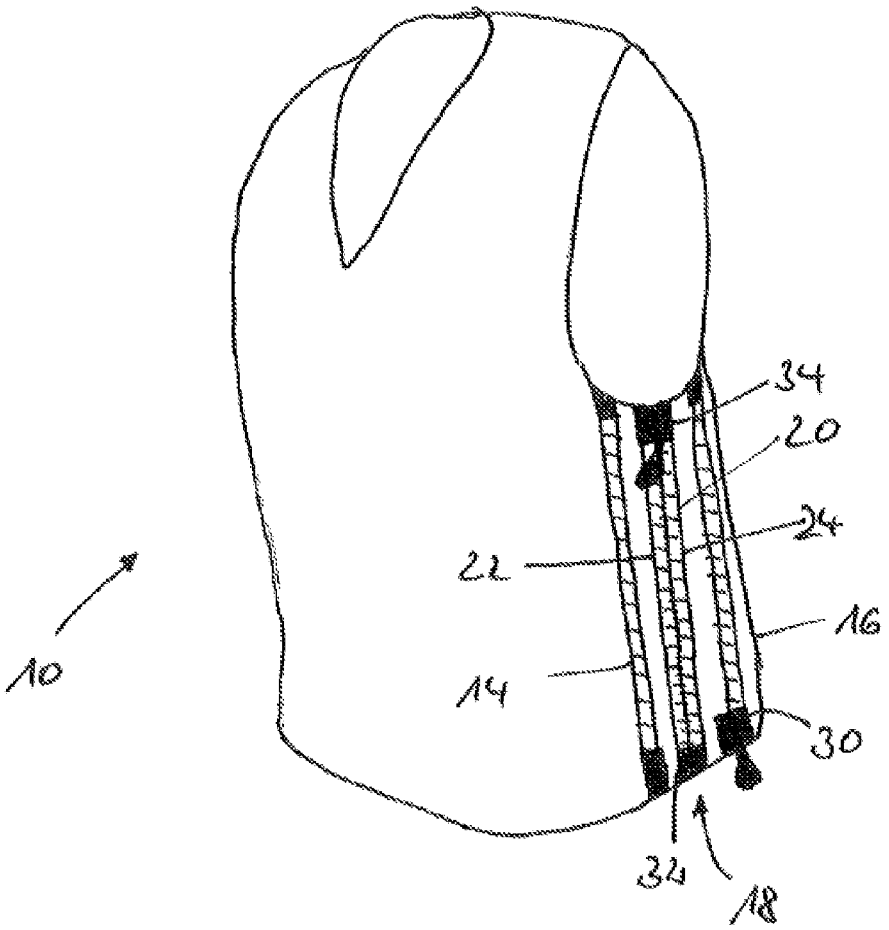
FIG. 2 shows a garment according to the invention in a second state.

When the outer zipper 12 is opened by moving the slider 30 toward the end piece 28 the image shown in FIG. 2 is obtained. The rows of teeth 14, 16 of the outer zipper 12 are now spaced apart while being connected or held together at a distance by the material 18. A particularity of the present example is that the material 18 between the rows of teeth 14, 16 includes an inner zipper 20 which in turn comprises two rows of teeth 22, 24, an end piece 32 and a slider 34. The inner zipper 20 is sewn into the garment 10 in the same orientation as the outer zipper 12. This is in no way required. Any orientation and any combination of orientations are within the scope of the present invention.

If the two states of the garment shown in FIGS. 1 and 2 are compared it becomes obvious that the garment 10 has different sizes in the two states, the garment being smaller in the state according to FIG. 1 in which the outer zipper 12 is closed than in the state according to FIG. 2 in which the outer zipper 12 is opened.

Figure 3:
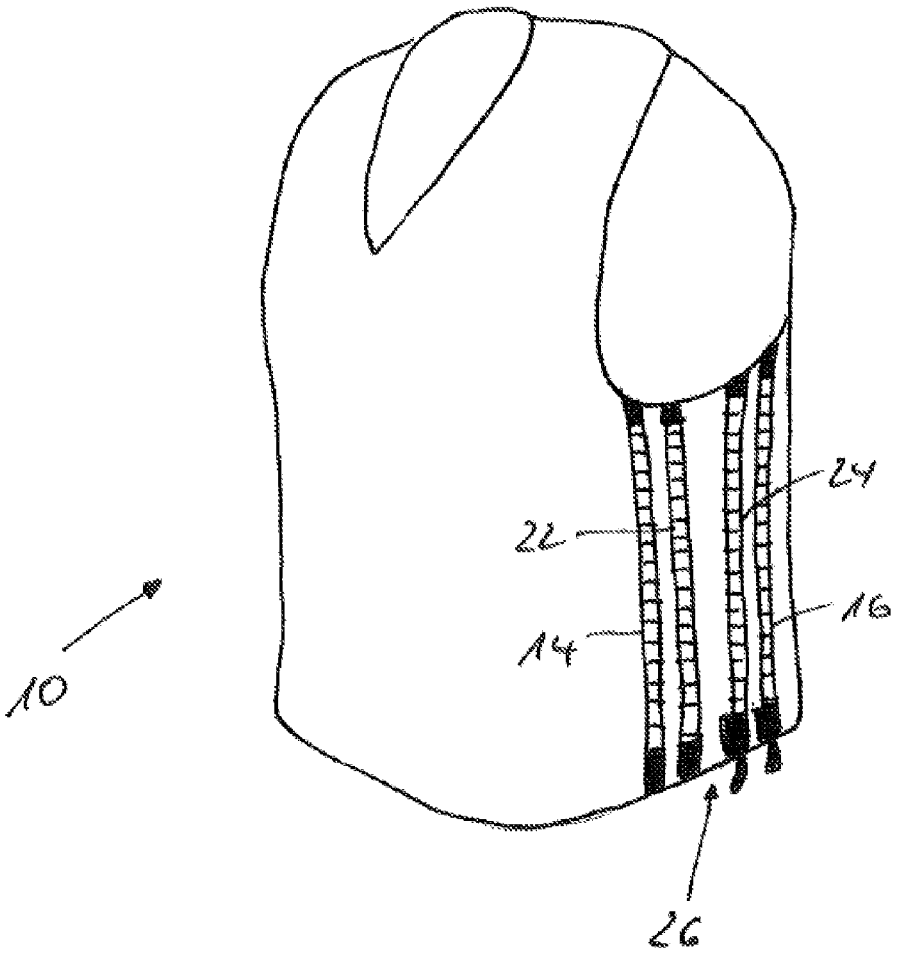
FIG. 3 shows a garment according to the invention in a third state.

Now, FIG. 3 shows another state of the garment 10. Here, the inner zipper 20 with its rows of teeth 22, 24 is also opened. The rows of teeth 22, 24 of the inner zipper 20 are also held together at a distance by the material 26. With the state illustrated in FIG. 3 now a third size of the garment 10 is realised, in addition to the two sizes illustrated in FIGS. 1 and 2.

Figure 4:
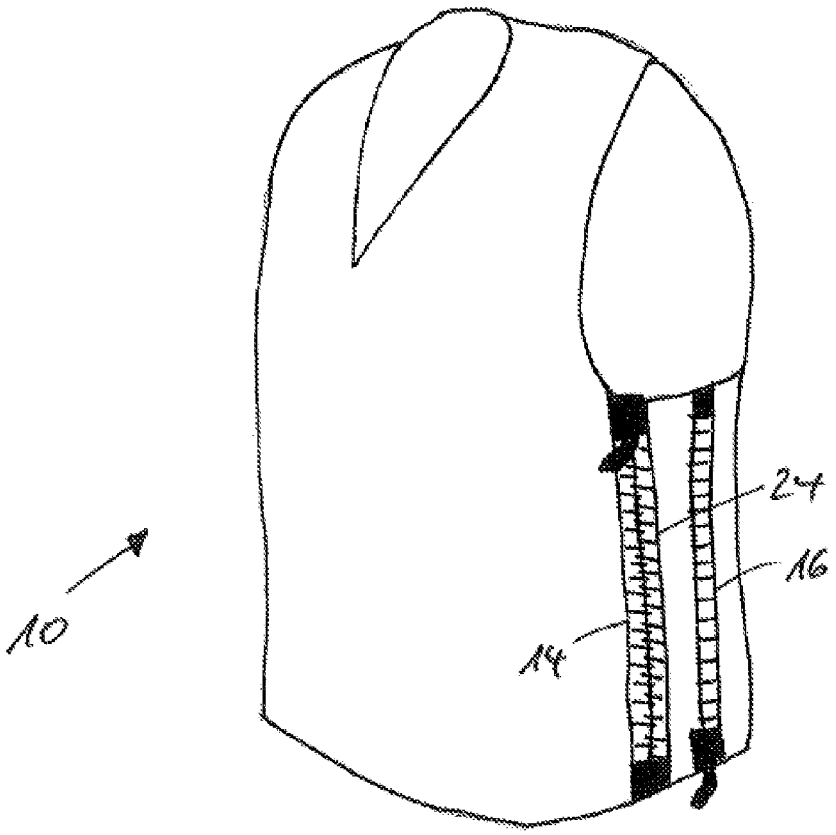
FIG. 4 shows a garment according to the invention in a fourth state.

However, it is also possible to realise further sizes with the present zipper arrangement. This will be explained in connection with FIG. 4. In the state illustrated here, the row of teeth 24 of the inner zipper 20 is coupled with the row of teeth 14 of the outer zipper. This results in an intermediate size ranging between the sizes the garment 10 has according to FIGS. 1 and 2. It would likewise be possible, starting from the state illustrated in FIG. 3, to couple the row of teeth 22 of the inner zipper 20 to the row of teeth 16 of the outer zipper 12.

With the aid of FIG. 2, another aspect of the present invention can be explained. FIG. 2 shows a complete zipper 20 which is exposed when the outer zipper 12 is opened. Likewise, however, it would be possible to, for example, provide only a single row of teeth instead of the complete zipper 20. This single row of teeth may then be coupled with one of the rows of teeth 14, 16 of the outer zipper 12 to realise an intermediate size in this way as well.

Another variant of the present invention can be explained with reference to FIG. 3. Here it is contemplated that the material 26 between the rows of teeth 22, 24 of the inner zipper has no specific particularities. It may simply be the textile fabric of which the remaining garment 10 also fully or partly consists. However, it would, again, also be possible to provide yet another zipper in the area of the material 26 which would then have a functional relationship with the inner zipper 20 comprising the rows of teeth 22, 24 like the inner zipper 20 has with the outer zipper 12. Likewise, of course, also only a single row of teeth or a plurality of independent rows of teeth may be provided between the rows of teeth 22, 24 of the inner zipper 20.

The thus described nesting of zippers or rows of teeth may be continued as desired so that finally a multitude of zippers together form the zipper arrangement.

The described zipper arrangement as a whole may be offered as a textile component. The textile component will then be sewn into a garment like a single zipper.

In the embodiment described above only a single zipper arrangement is shown. Preferably a zipper arrangement which may be identical or different in design as compared to the described zipper arrangement is also present on the other side of the garment, namely below the other arm opening. Likewise, it might be contemplated to provide zipper arrangements between the lower edge of the garment and the head opening, be it in the breast and/or in the back area. Zipper arrangements may also extend horizontally, for example between the two arm openings. In this way, the length of a garment may be varied.

The features of the invention disclosed in the above description, in the drawings, as well as in the claims may be essential for the implementation of the invention individually as well as in any combination.

The invention claimed is:

1. A garment, which is adjustable in its size, wherein at least one outer zipper having two rows of teeth coupleable to each other and one sliding piece is provided, wherein the garment has a first size in a closed state of the outer zipper and a second size in an opened state of the outer zipper, wherein the first size is smaller than the second size, wherein, in the opened state of the outer zipper, the rows of teeth are held together at a distance by material covered by the outer zipper in the closed state of the outer zipper; and wherein an inner zipper having two rows of teeth coupleable to each other and one sliding piece is provided which is at least partly covered by the outer zipper in the closed state of the outer zipper and which is exposed in the opened state of the outer zipper, wherein the garment has the second size in an opened state of the outer zipper and a closed state of the inner zipper, wherein the garment has a third size in an opened state of the outer zipper and an opened state of the inner zipper, wherein in the opened state of the outer zipper and in the opened state of the inner zipper, at least one of the rows of teeth of the outer zipper can be coupled with at least one of the rows of teeth of the inner zipper in the manner of a zipper, thereby providing a fourth size of the garment.

2. The garment according to claim 1, wherein in the opened state of the inner zipper, the rows of teeth are held together at a distance by a material covered by the inner zipper in the closed state of the inner zipper.

* * * * *